US008947179B2

(12) United States Patent
Haunberger et al.

(10) Patent No.: US 8,947,179 B2
(45) Date of Patent: Feb. 3, 2015

(54) TUNABLE HIGH-FREQUENCY FILTER

(75) Inventors: Thomas Haunberger, Bad Reichenhall (DE); Manfred Stolle, Bad Aibling (DE)

(73) Assignee: Kathrein-Werke KG, Rosenheim (DE)

( * ) Notice: Subject to any disclaimer, the term of this patent is extended or adjusted under 35 U.S.C. 154(b) by 81 days.

(21) Appl. No.: 13/996,957

(22) PCT Filed: Dec. 15, 2011

(86) PCT No.: PCT/EP2011/006357
§ 371 (c)(1),
(2), (4) Date: Jun. 21, 2013

(87) PCT Pub. No.: WO2012/084154
PCT Pub. Date: Jun. 28, 2012

(65) Prior Publication Data

US 2013/0271243 A1 Oct. 17, 2013

(30) Foreign Application Priority Data

Dec. 23, 2010 (DE) ..... 10 2010 056 048

(51) Int. Cl.
*H01P 3/06* (2006.01)
*H01P 1/202* (2006.01)
*H01P 7/04* (2006.01)

(52) U.S. Cl.
CPC . *H01P 1/202* (2013.01); *H01P 7/04* (2013.01)
USPC ..... 333/207; 333/206

(58) Field of Classification Search
USPC ..... 333/206, 207
See application file for complete search history.

(56) References Cited

U.S. PATENT DOCUMENTS 4,380,747 A 4/1983 Curtinot et al.
4,728,913 A 3/1988 Ishikawa et al.
6,407,651 B1 6/2002 Wulff et al.
6,727,786 B2 * 4/2004 Toncich ..... 333/219.2

(Continued)

FOREIGN PATENT DOCUMENTS

CN 2371675 Y 3/2000
CN 1347578 A 5/2002

(Continued)

OTHER PUBLICATIONS

International Search Report for PCT/EP2011/006357, mailed May 9, 2012.

(Continued)

*Primary Examiner* — Adam Houston
(74) *Attorney, Agent, or Firm* — Nixon & Vanderhye P.C.

(57) ABSTRACT

The invention discloses a high-frequency filter in coaxial design which allows a simple option for tuning resonators contained in the high-frequency filter. In order to tune the resonator(s), a first tuning element is mechanically anchored in the second terminating wall such that the element is rotationally fixed and the axial length thereof cannot be varied, and a second tuning element, the position of which can be varied, is provided in the longitudinal opening of the inner conductor, wherein the second tuning element consists of a dielectric material, or comprises dielectric material, at least in the region facing the second outside wall, wherein the axial position of the second tuning element can be varied in the spacing area between the inside face of the inner conductor and the first tuning element. The second tuning element can be accessed and/or actuated from the outer side of the first terminating wall to effect a variation of the axial position.

18 Claims, 2 Drawing Sheets

(56) References Cited

U.S. PATENT DOCUMENTS

| | | | | |
|---|---|---|---|---|
| 6,737,930 | B2 * | 5/2004 | Toncich | 333/24 C |
| 6,741,217 | B2 * | 5/2004 | Toncich et al. | 343/772 |
| 6,742,240 | B2 * | 6/2004 | Mikkonen | 29/601 |
| 6,744,327 | B2 * | 6/2004 | Toncich et al. | 331/117 R |
| 2005/0253673 | A1 | 11/2005 | Killer | |
| 2008/0024248 | A1 * | 1/2008 | Sieber et al. | 333/207 |
| 2012/0007697 | A1 * | 1/2012 | Tiihonen | 333/202 |
| 2012/0105176 | A1 * | 5/2012 | Kapfinger | 333/209 |
| 2013/0271243 | A1 * | 10/2013 | Haunberger et al. | 333/207 |

FOREIGN PATENT DOCUMENTS

| | | | |
|---|---|---|---|
| CN | 1697250 | A | 11/2005 |
| CN | 1949585 | A | 4/2007 |
| CN | 101490899 | A | 7/2009 |
| DE | 38 12 782 | | 10/1989 |
| DE | 10 2004 045 006 | | 3/2006 |
| EP | 1 169 747 | | 6/2002 |
| EP | 1 596 463 | | 11/2005 |
| EP | 1 760 824 | | 3/2007 |
| EP | 1 721 359 | | 6/2007 |
| EP | 1 776 733 | | 11/2008 |
| EP | 2 044 648 | | 10/2009 |
| EP | 1 825 559 | | 8/2010 |
| FR | 2 507 018 | | 12/1982 |
| WO | WO 2006/063640 | | 6/2006 |

OTHER PUBLICATIONS

Foreign-language Written Opinion of the International Searching Authority for PCT/EP2011/006357, mailed May 9, 2012.

English-language International Preliminary Report on Patentability and Written Opinion of the International Searching Authority dated Jun. 25, 2013, issued in corresponding International Application No. PCT/EP2011/006357.

Chinese Search Report dated Aug. 4, 2014, issued in Chinese Application No. 201180059212.1.

* cited by examiner

TUNABLE HIGH-FREQUENCY FILTER

This application is the U.S. national phase of International Application No.

PCT/EP2011/006357, filed 15 Dec. 2011, which designated the U.S. and claims priority to DE Application No. 10 2010 056 048.0, filed 23 Dec. 2010, the entire contents of each of which are hereby incorporated by reference.

The invention relates to a high-frequency filter of a coaxial construction in accordance with the preamble of claim 1.

In radio systems, in particular in the mobile radio sector, a shared antenna is often used for transmitted and received signals. In this context, the transmitted and received signals each use different frequency ranges, and the antenna has to be suitable for transmitting and receiving in the two frequency ranges. Therefore, to separate the transmitted and received signals, suitable frequency filtering is required with which, on the one hand, the transmitted signals are passed from the transmitter to the antenna and, on the other hand, the received signals are passed on from the antenna to the receiver. Nowadays, high-frequency filters of a coaxial construction are used for splitting up the transmitted and received signals.

For example, a pair of high-frequency filters may be used which both allow a particular frequency band to pass through (band-pass filters). Alternatively, a pair of high-frequency filters may be used which both block a particular frequency band (band-block filters). Further, a pair of high-frequency filters may be used of which one filter allows frequencies below a frequency between the transmitting and receiving band to pass through and blocks frequencies above this frequency (low-pass filter), and the other blocks filter frequencies below a frequency between the transmitting and receiving band and allows frequencies above this to pass through (high-pass filter). Further combinations of the aforementioned filter types are also conceivable.

High-frequency filters are often in the form of coaxial resonators, since these consist of milled or cast parts, making them simple to produce. Furthermore, these resonators ensure a high electrical quality and relatively high thermal stability.

EP 1 776 733 B1 discloses an example of a coaxial high-frequency filter. This filter comprises an external conductive cup, which is attached to a metal-coated base plate and in which an internal conductor is arranged. In the inner region of the external conductive cup, a region of the substrate is excluded from metal-coating, in such a way that the part of the internal conductor contacting the substrate is galvanically isolated from the external conductive cup. The opposite end of the internal conductor is galvanically connected to the internal conductive cup at the opposite end thereof. On the opposite side of the substrate, the filter further comprises a strip conductor, which is electrically coupled to the resonator. As a result of manufacturing tolerances of a coaxial resonator of this type, it further has to be tuned, and this is brought about by adjusting or altering the lengths of the internal conductors. The corresponding adjustment or alteration to the length of the internal conductors requires an adjustment means, for example in the form of an internal or external thread, and this leads to undesirable intermodulation effects in the respective resonators.

EP 2 044 648 B1 discloses an example of a coaxial high-frequency filter. This filter comprises a resonator having an internal conductor and an external conductor, a tuning element which comprises an external thread being provided in an end wall of the resonator. In the corresponding end wall, a threaded recess having an internal thread is provided. The thread pitch of the external thread of the tuning element differs from the thread pitch of the internal thread of the threaded recess in at least one sub-portion of the internal thread and of the external thread, resulting in automatic self-locking of the tuning element. As a result of the threading error between the external thread and the internal thread, a maximum bias is set between the external thread of the threaded member and the internal thread of the threaded hole in the resonance filter housing at the axially remote thread portions, resulting in electrical conditions which are unambiguously reproducible at these points as a result of the high contact forces, making it possible to prevent undesirable intermodulation effects.

A further example of a coaxial high-frequency filter is disclosed in document EP 1 169 747 B1. This filter comprises a resonator having a cylindrical internal conductor and a cylindrical external conductor, a capacitor which affects the resonant frequency being formed between a free end of the internal conductor and a cover which is fixed to the external conductor. The resonator further comprises a tuning element made of dielectric material, with which the resonant frequency of the filter can be adjusted. The tuning element is movable in the internal conductor of the resonator, in such a way that the side of the tuning element facing the cover is at different distances from the cover, altering the capacitance between the free end of the internal conductor and the cover of the resonator and in turn varying the resonant frequency.

DE 38 12 782 A1 discloses a cavity resonator or coaxial resonator. The coaxial resonator comprises a cup-shaped body having two opposite end walls, namely having a first end wall and a second end wall opposite it and at a distance therefrom, between which a housing wall is provided peripherally. A hollow cylinder is galvanically connected to the first end wall, extends perpendicularly from the first end wall towards the second end wall, and ends at a distance from the second end wall. A piston, which is connected to a plunger, protrudes through the second end wall towards the first end wall and ends above the end face of the hollow cylinder. A tuning element is provided so as to be variable in position in a longitudinal recess of the hollow cylinder and comprises an isolation pin, which is provided between a part of the tuning element having an external thread and a tuning plunger for isolating the tuning plunger. The isolation pin is provided in the upper part of the tuning plunger and the tuning element is variable in the axial position thereof and is accessible from the outside of the first end wall so as to alter the axial position. Attached to the piston are two pairs of tube magnets, on which a magnetic field produced by an adjacently arranged coil can exert a force, altering the axial position of the piston together with the plunger by inducing current in the coil.

U.S. Pat. No. 4,380,747 discloses a high-frequency filter comprising a first end wall and a second end wall at a distance therefrom. A metal finger, provided with a longitudinal recess, is galvanically connected to the first end wall and extends perpendicularly from the first end wall towards the second end wall. In this context, the metal finger ends at a distance from the second end wall. A pin-like filter housing, protruding towards the first end wall, is screwed into the second end wall by means of an external thread, and is thus electrically/galvanically connected thereto. The filter housing ends at the level of the end face of the metal finger, or dips into the longitudinal recess formed in the metal finger. A tuning bolt is providing so as to be longitudinally movable in the filter housing. U.S. Pat. No. 4,380,747 also discloses that the hollow finger may alternatively be movable, and in this case the filter housing referred to as a finger is fixed in the second end wall together with the tuning bolt. In this case, the tuning bolt is movable in the unmovable finger, and can thus be operated from the upper side of the high-frequency filter.

In summary, it may be established that it is necessary to tune the coaxial high-frequency filter using a tuning element, as a result of manufacturing tolerances. In prior art high-frequency filters, the tuning is carried out using threaded screws made of metal or made of combinations of metal screws and plastics material elements. Resonator housings made of aluminium require interference threads for receiving the corresponding tuning elements, since aluminium is too soft for fine threads, and so the thread of the adjustment element can seize up. Furthermore, the tuning elements in the prior art coaxial high-frequency filters are arranged at high-frequency critical points, in such a way that currents also flow through the contact region of the external thread of the tuning element and the internal thread of the resonator housing. This leads to intermodulation problem points, since there are insufficient contact pressures in the thread. In EP 2 044 648 B1, this problem is addressed using biased threads. However, a coaxial high-frequency filter of this type is complex to produce and thus costly. Tuning sleeves consisting of metal or of a combination of metal and plastics material, for example having a special thread, are also complex to produce and thus expensive.

Starting from the conventional prior art, the object of the present invention is therefore to provide an improved and simplified option for tuning resonators, that is to say individual resonators, high-frequency filters, frequency filters, band-pass filters, band-block filters and the like, which option is more cost-effective to implement and which does not have the aforementioned intermodulation problems.

The object is achieved according to the invention in accordance with the features specified in claim 1. Advantageous embodiments of the invention are provided in the dependent claims.

Thus, according to the invention, a first pin-shaped or pin-like first tuning element, which protrudes towards a first end wall and which is electrically/galvanically connected to a second end wall of the resonator, is mechanically anchored in the second end wall so as to be invariable in the axial length thereof and fixed in rotation. A preferably tubular or tube-like positionally variable second tuning element is provided in a longitudinal recess in the internal conductor of the resonator, and consists of a dielectric material at least in the region facing the second outer wall. This second tuning element is variable in its axial position in the space between the inner face of the internal conductor and the first tuning element. In this context, the second tuning element is accessible and can be actuated from the outside of the first end wall so as to bring about this change in axial position.

The single-piece second tuning elements, which consist at least in part of dielectric material, are therefore arranged at points in the coaxial resonator which are non-critical in terms of intermodulation effects, resulting in the coaxial resonator being tuned by means of the second tuning element, which is accessible and positionally variable via the first end wall or via the base of the coaxial resonator. The first tuning element, also referred to as a tuning pin, is soldered in or contacted in the coaxial resonator, in such a way that no intermodulation problems occur at the corresponding contact points.

As a result, tuning of the coaxial resonator is possible, since the second tuning element is accessible via the base face or via the side of the first end wall, and the axial position of the second tuning element is brought about by actuating the second tuning element at the base face or at the side of the first tuning wall. The filter characteristic or the electrical parameters of the coaxial high-frequency resonator are adjusted and/or varied and/or corrected using the adjustable second tuning element, without causing any intermodulation problems, since there is no galvanic connection between the tuning pins or bolts, referred to as the first tuning elements, and the second tuning elements. The length of the tuning pins or the first tuning elements is preselected in such a way that the coaxial high-frequency filer is only fine-tuned by means of the second tuning elements at the ends of the tuning pins. As a result, there are also no quality losses to be expected in the high-frequency filter. Further, the solution according to the invention has the advantage that the second tuning elements additionally provide mechanical support or centring of the tuning pins or first tuning elements. As a result, the mechanical stability of the high-frequency filter is additionally increased.

The solution according to the invention is more cost-effective to produce, since it is possible merely to use simple rotary parts as tuning pins or as first tuning elements, rather than expensive tuning pins having a special thread. The second tuning elements can be produced cost-effectively as cast parts, and can be fixed and adjusted in the axial position thereof using simple measures.

In a preferred embodiment, the second end wall or the cover of the resonator comprises a dielectric plate material, on the outside of which an earth plane is provided, to which the first tuning element is electrically/galvanically connected. In this context, the earth plane may alternatively also be arranged in the dielectric plate material. The outer face of the second end wall or cover is the side of the second cover wall or cover remote from the first end wall.

In this context, a strip conductor construction is preferably provided on the inside of the first end wall. The inside of the first end wall or cover is the side of the first end wall or cover facing the second end wall.

In this context, the strip conductor construction preferably comprises a coupling plane, in which a recess is provided, which is electrically/galvanically isolated from the coupling plane. In this context, the coupling plane is arranged on the inside of the first end wall in such a way that the coupling plane is opposite the end face of the internal conductor. In this context, the first tuning element protrudes through the recess into the internal conductor.

The coaxial resonator is thus coupled to the strip conductor construction of the first end wall or cover, which can also be configured as a circuit board, via the coupling planes of the internal conductor. The second end wall can thus be provided as a circuit board to which an adaptation or filter construction is attached. In this context, the adaptation or filter construction is arranged on the inner face of the filter. The earth plane to which the tuning pins are attached is provided on the outside of the circuit board. In this context, the branch lines are formed as coaxial resonators for reasons of filter quality.

Preferably, the second tuning element comprises a blind hole or through-hole which extends in the longitudinal direction of the second tuning element, and the second tuning element is positionally variable within the longitudinal recess in the internal conductor of the resonator, in terms of the axial position thereof with respect to the first tuning element, in such a way that the first tuning element can be dipped different distances into the blind hole or through-hole of the second tuning element.

Preferably, the first tuning element and the second end wall or cover of the resonator are connected by an interference fit or by soldering or by welding. On the other hand, the first tuning element and the second end wall may preferably also be formed integrally.

Further, the external conductor housing of the resonator may preferably be formed integrally with the internal conductor, in particular as a milled, turned or cast part, in such a way that there are no intermodulation problems resulting from joints in the filter.

In a further preferred embodiment, the external conductor housing and/or the internal conductor and/or the first tuning element may consist of plastics material, the respective outer surfaces being metal-coated. This makes particularly cost-effective production of the high-frequency filter possible.

In a particularly preferred embodiment, the second tuning element comprises an external thread, and the internal conductor and/or a recess of the first end wall comprise a corresponding internal thread, the second tuning element, via the external thread thereof, being connected to and held on the internal thread of the internal conductor and/or the recess of the first end wall. As a result, it is possible to vary the axial position of the second tuning element with respect to the first tuning element in a particularly simple manner.

In a preferred embodiment, to compensate a change in resonant frequency of the high-frequency filter, the thermal expansion coefficient of the second tuning element may be different from the thermal expansion coefficient of the internal conductor or of the external conductor housing. In this context, the thermal expansion coefficient of the second tuning element is preferably less than the thermal expansion coefficient of the internal or external conductor.

In this context, the second tuning element preferably comprises a ceramic material.

In a particularly preferred embodiment of the filter according to the invention, air is provided as the dielectric between the internal conductor and the housing wall of the external conductor housing.

Further, a plurality of resonators may preferably be provided in a high-frequency filter according to the invention, the strip conductor construction comprising a number of coupling planes corresponding to the number of resonators, said coupling planes being electrically/galvanically interconnected via a conductor path. In this context, the respective coupling planes are arranged on the inside of the circuit board in such a way that they are positioned opposite the end faces of the internal conductor.

In this context, the plurality of resonators may preferably be of different sizes. Accordingly, the resonators may preferably be configured and coupled so as to form a duplex filter.

Further, in a particularly preferred embodiment, a resonator of a high-frequency filter according to the invention may be formed in such a way that a band-pass filter and/or a band-block filter are formed.

The aforementioned filters may operate for the range between 790 MHz and 862 MHz (frequency bands freed up as a result of digitalisation; also known as digital dividends) as well as for the range between 870 MHz and 960 MHz (GSM 900) and in the range of the 1800 MHz mobile radio frequency and/or the 2000 MHz mobile radio frequency.

In the following, the invention is described in greater detail by way of drawings, in which, in detail:

Figure 1:
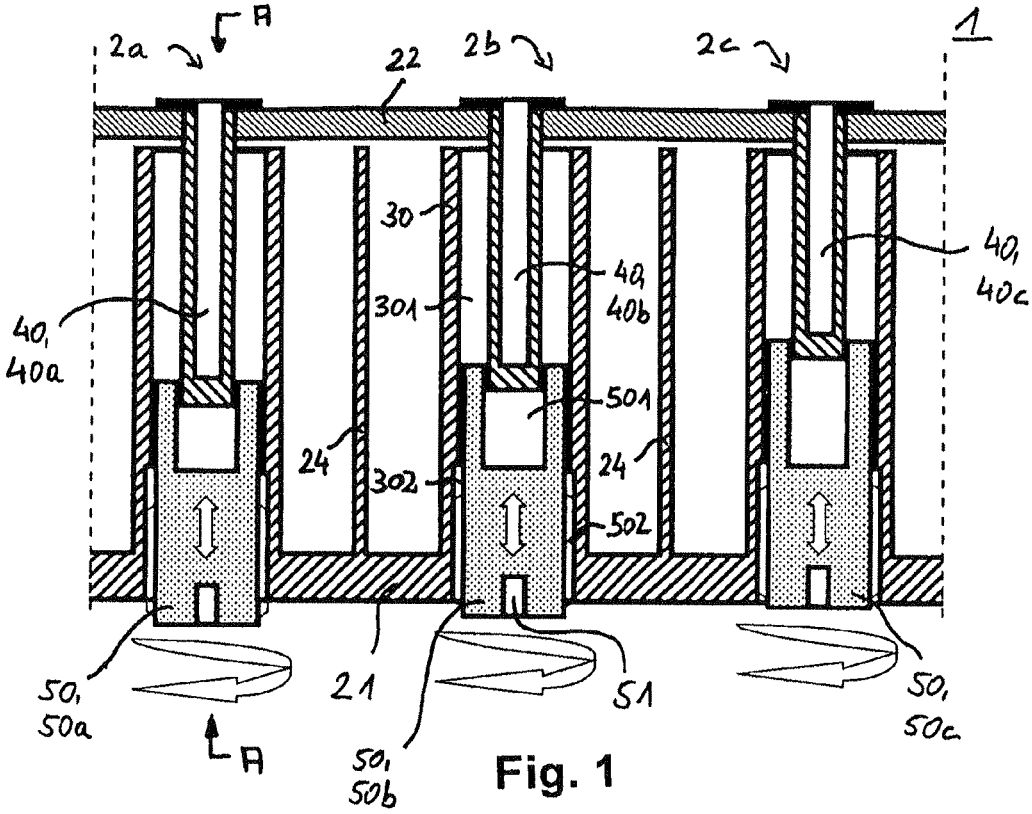
FIG. 1 is a schematic axial cross-section through a high-frequency filter according to the invention in the form of three individual resonators arranged side by side.
Figure 2:
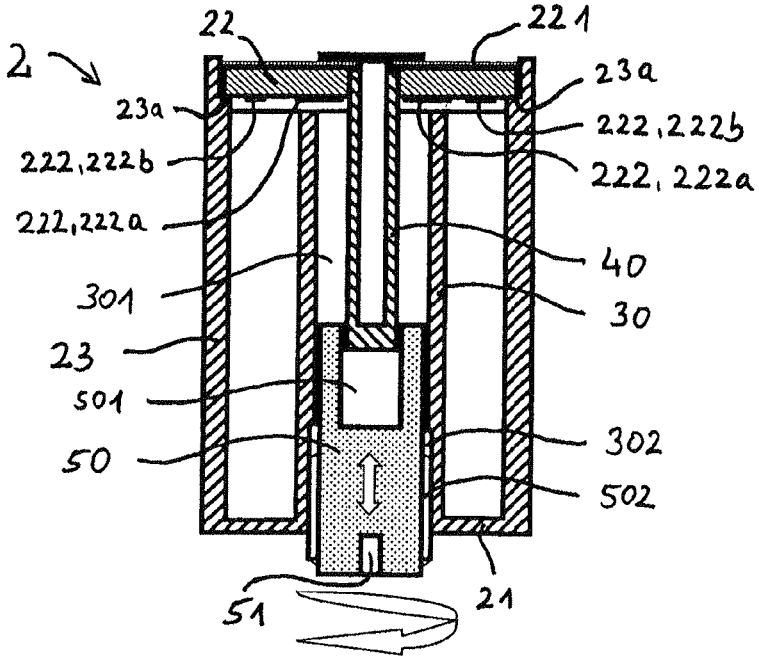
FIG. 2 is a schematic axial cross-section through the high-frequency filter according to the invention along the plane a-a.
Figure 3:
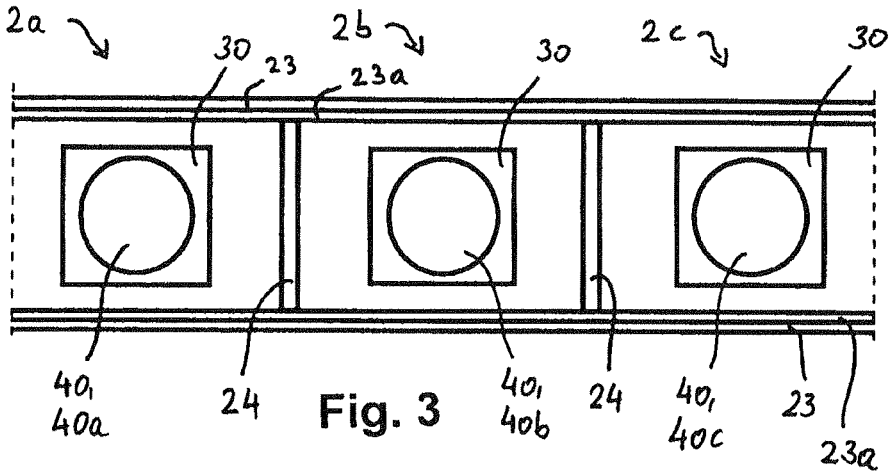
FIG. 3 is a schematic horizontal cross-section of the filter of FIGS. 1 and 2.

FIGS. 1 to 3 show schematically a high-frequency filter 1 having three resonators 2*a*, 2*b*, 2*c* of a coaxial construction, in an axial longitudinal section, an axial cross-section and a cross-section transverse thereto. In the following, an individual resonator 2*a*, 2*b*, 2*c* of a coaxial construction is also referred to as a coaxial resonator or coaxial filter for short.

A high-frequency filter 1 of a coaxial construction may also comprise more or fewer than the three shown coaxial filters or individual resonators.

In the following, the construction of an individual resonator 2*a*, 2*b*, 2*c* is explained by way of FIGS. 1 to 3. In this context, like reference numerals denote like components or features so as to avoid repetitions. Further, the construction of an individual resonator 2*a*, 2*b*, 2*c* is shown in FIG. 1 using the example of the resonator 2*b* shown in the centre, the adjacent resonators 2*a*, 2*c* being of an identical or similar construction.

The coaxial resonator 2*a*, 2*b*, 2*c* comprised in the high-frequency filter 1 according to the invention comprises an external conductor housing having two opposite end walls 21, 22, namely a first end wall 21 and a second end wall 22 at a distance therefrom. The first end wall 21 may also alternatively be referred to as the base of the coaxial resonator 2*a*, 2*b*, 2*c*. Further, the second end wall 22 may alternatively be referred to as the cover 22 of the coaxial resonator 2*a*, 2*b*, 2*c*. In this context, the cover 22 may be configured as a circuit board 22. A housing wall 23 is provided peripherally between the first end wall 21 and the second end wall 22, and is shown in part in FIG. 3. In FIG. 3, the terminal housing walls 23 on the left and right sides of the high-frequency filter are not shown. It can be seen from FIGS. 2 and 3 that the housing wall 23 comprises an impression 23*a* or depression 23*a* on which the second end wall 22 may be placed. The coaxial resonator 2*a*, 2*b*, 2*c* further comprises an internal conductor 30, which is configured as an internal conductor tube in the embodiment shown in FIGS. 1 to 3. In FIGS. 1 and 2, the internal conductor 30 and the first end wall 21 are formed integrally. However, the internal conductor 30 and the first end wall 21 may also be formed in two pieces and be interconnected for example by welding or soldering or for example an interference fit. The internal conductor 30 is galvanically connected to the first end wall 21, and extends perpendicularly from the first end wall 21 towards the second end wall 22, the internal conductor 30 failing to contact the second end wall 22. The internal conductor 30 is therefore galvanically isolated from the cover 22. Galvanic isolation of the internal conductor 30 from the cover 22 can also be achieved in that the internal conductor 30 consists of a dielectric material at a contact point of the internal conductor 30 with the second end wall 22 of the internal conductor 30, or the cover 22 consists of a dielectric material at a contact point with the internal conductor 30. However, in the embodiment shown in FIGS. 1 and 2, the galvanic isolation between the internal conductor 30 and the second end wall 22 is achieved in that the internal conductor 30 fails to contact the second end wall 22.

It can be seen from FIG. 2 that the second end wall 22 is configured as a circuit board 22. An earth plane 221 is attached to the outside of the circuit board 22. In this context, the outside of the circuit board 22 is the side of the circuit board 22 remote from the first end wall 21. Alternatively, the earth plane could also be arranged in the circuit board 22 or in the dielectric plate material. A strip conductor construction 222, shown in a plan view in FIG. 4, is attached to the inside of the circuit board 21.

The strip conductor construction 222 comprises at least one coupling plane 222*a*, in which a recess 222*c* is provided. The coupling plane 222*a* is arranged on the inside of the circuit board 22, in such a way that the coupling plane 222*a* is arranged opposite the end face of the internal conductor 30. The coaxial resonator is thus coupled to the strip conductor construction 222 of the circuit board 22 via the coupling planes of the end face of the internal conductor 30. In this context, the first tuning element 40 protrudes through the recess 222*c*, which is electrically/galvanically isolated from the coupling plane 222*a*.

Figure 4:
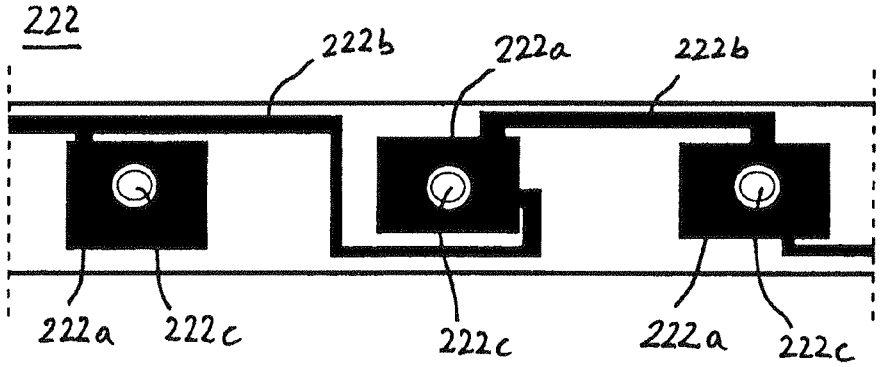
FIG. 4 is a plan view of a strip conductor construction attached to the inner face of the second end wall.

FIG. 4 shows that the strip conductor construction 222 comprises three coupling planes 222*a*. The coupling planes 222*a* are electrically/galvanically interconnected by conductor paths 222*b* in each case. Thus, in the embodiment of the high-frequency filter 1 shown in FIGS. 1 and 3, the end faces of each of the internal conductors 30 of the individual resonators 2*a*, 2*b*, 2*c* are arranged opposite a coupling plane 222*a* of the strip conductor construction 222. The individual resonators 2*a*, 2*b*, 2*c* thus form branch lines on the strip conductor construction 222.

The coaxial resonator 2*a*, 2*b*, 2*c* further comprises a pin-shaped or pin-like tuning pin or a first tuning element 40, which protrudes towards the base 21 of the coaxial resonator 2*a*, 2*b*, 2*c*. This first tuning element 40 is electrically/galvanically connected to the earth plane 221 of the second end wall 22. Alternatively, however, the electric/galvanic connection may also be implemented by a connecting line on or outside the second end wall 22, in particular if the second end wall consists of a dielectric substrate. In the case where the second end wall 22 consists of a dielectric material, if the second end wall 22 is for example a circuit board 22, the outer surface of the circuit board 22 is provided with an earth plane, and an adaptation or filter construction 222 can be attached to the inside of the circuit board 22. In this case, the first tuning pins 40 are galvanically connected to the earth plane 221 on the outside of the circuit board 22.

FIGS. 1 and 2 show the first tuning element 40 as a hollow body. However, the first tuning element 40 may also be formed solidly. In FIGS. 1 and 2, the first tuning element 40 dips into a longitudinal recess 301 formed in the internal conductor tube 30. However, the first tuning element 40 can also end at the level of the end face of the internal conductor 30.

In this context, the first tuning element 40 or tuning pin 40 is invariable in the axial length thereof and is mechanically anchored in the cover 22 so as to be fixed in rotation. This ensures that the contact between the first tuning element 40 and the earth plane 221 of the second end wall 22 or the aforementioned connecting line located thereon has reproducible properties and features which are always the same. In the embodiment shown, the coaxial resonator 2*a*, 2*b*, 2*c* further comprises a tubular or tube-like and positionally variable second tuning element 50, which is arranged in the longitudinal recess 301 of the internal conductor 30. In FIGS. 1 and 2, the second tuning element 50 comprises a blind hole 501 extending in the longitudinal direction of the second tuning element 50, and the second tuning element 50 is positionally variable within the longitudinal recess 301 in the internal conductor 30, in terms of the axial position thereof with respect to the first tuning element 40 or tuning pin 40, in such a way that the first tuning element 40 can dip different distances into the blind hole 501 of the second tuning element 50. Instead of the blind hole 501, a through-hole 501 may also be provided in the second tuning element 50. However, the present invention is not limited to a configuration of this type of the second tuning element 50. The second tuning element 50 may be of any form which ensures that the second tuning element 50 is positioned variably in the space between the inner surface of the internal conductor 30 and the first tuning element 40 in terms of the axial position thereof. For example, concentrically arranged tuning pins which are positionally variable in terms of the axial position thereof with respect to the first tuning element 40 would also be conceivable.

The second tuning element 50 shown in FIGS. 1 and 2 consists of a dielectric material. However, the second tuning element 50 may also consist of a metal material, the second tuning element 50 consisting of a dielectric material at least in the region adjacent to and facing the second outer wall 22 and the first tuning element 40. This dielectric material may be any type of plastics material, but may also comprise a ceramic material.

In the embodiment shown in FIGS. 1 and 2, the second tuning element 50 comprises an external thread 502 via which the second tuning element 50 is connected to and held on an internal thread 302 in the interior of the internal conductor 30. By rotating the second tuning element 50 as indicated, the axial position of the second tuning element 50 is therefore varied, in such a way that the first tuning element 40 dips different distances into the blind hole 501 of the second tuning element 50. The second tuning element 50 may be rotated for example by introducing a rotation tool into the engagement 51 of the second tuning element 50. As a result, the second tuning element 50 is accessible and can be actuated from the outside of the first end wall 21 so as to bring about a change in axial position.

However, the present invention is not limited to this. For example, the second tuning element 50 could be connected to the internal conductor 30 via a sliding bearing and be slid or pulled different distances into or out of the longitudinal recess 301 of the internal conductor via a corresponding actuating device, in such a way that the first tuning element 40 dips different distances into a corresponding blind hole 501 or through-hole 501 in the second tuning element 50.

FIGS. 1 and 2 show that the first tuning element 40 is in contact with the blind hole 501 of the second tuning element 50. As a result, the second tuning element 50 can further act as a mechanical support or a mechanical centring of the first tuning element 40, increasing the mechanical stability of a correspondingly constructed coaxial resonator 2*a*, 2*b*, 2*c*.

In the embodiment shown in FIGS. 1 to 3, air is provided as a dielectric between the internal conductor 30 and the housing wall 23 of the external conductor housing. However, a different gaseous dielectric may also be provided between the internal conductor 30 and the housing wall 23.

In FIGS. 1 and 3, the high-frequency filter 1 according to the invention comprises at least three coaxial resonators 2*a*, 2*b*, 2*c*, which are arranged linearly with respect to one another and are adjacent. These resonators 2*a*, 2*b*, 2*c* are interconnected via a shared first end wall 21.

It can be seen from FIG. 1 that the first tuning element 40*a* in the coaxial resonator 2*a* shown on the left is of a greater length than the first tuning element 40*b* in the central coaxial resonator 2*b* or the first tuning element 40*c* in the coaxial resonator 2*c* shown on the right. As a result of the different lengths of the respective first tuning elements 40*a*, 40*b*, 40*c*, the resonance properties can be pre-set in the corresponding high-frequency filter 1, and finely adjusted using the respective second tuning elements 50*a*, 50*b*, 50*c*. As a result, the transmission or blocking properties of the high-frequency filter 1 can be set approximately and finely.

The resonators 2*a*, 2*b* and 2*c* are mutually separated by separating walls 24 in each case. These separating walls 24 need not necessarily extend the whole way from the first end wall 21 to the second wall 22, but may comprise a recess (aperture). This recess ensures that the separating walls 24 do not come into contact with the adaptation or filter construction 222 which is arranged on the inside of the second end wall 22 configured as a circuit board 22, detracting from the functionality of the conductor plate construction 222. By configuring the partition walls 24 appropriately, the filter properties of the high-frequency filter 1 can be adapted.

FIGS. 1 to 3 show the internal conductors 30 as having a square cross-section. However, the internal conductors 30 may also be of other shapes, such as a cylindrical shape having a round or elliptical cross-section. The cross-section of a corresponding internal conductor 30 may also be hexagonal, octagonal or decagonal. This also applies to the first tuning element 40, which is shown as having a circular cross-section in FIGS. 1 to 3. However, the first tuning element 40 may also be of a square, hexagonal, octagonal or decagonal cross-section.

In accordance with the configuration of the internal conductor 30, the second tuning element 50 may be of a corresponding shape, in such a way that the second tuning element 50 can be axially displaced in the longitudinal recess 301 of the internal conductor 30 in contact with the inner walls of the internal conductor 30.

List of Reference Numerals

1 high-frequency filter
2*a*, 2*b*, 2*c* resonator
21 first end wall
22 second end wall
23 housing wall
23*a* impression (of the housing wall)
24 separating wall
30 internal conductor
40, 40*a*, 40*b*, 40*c* first tuning element
50, 50*a*, 50*b*, 50*c* second tuning element
51 engagement
221 earth plane
222 strip conductor construction
222*a* coupling plane (of the strip conductor construction)
222*b* conductor path (of the strip conductor construction)
222*c* recess (of the strip conductor construction)
301 longitudinal recess (in the internal conductor)
302 internal thread (in the internal conductor)
501 blind hole or through-hole (in the second tuning element)
502 external thread (on the second tuning element)

The invention claimed is:

1. High-frequency filter of a coaxial construction, comprising one or more resonators, at least one of the resonators comprising:

an external conductor housing comprising two opposing end walls comprising a first end wall and a second end wall at a distance therefrom, between which a housing wall is provided peripherally, an internal conductor which is configured as an internal conductor tube, the internal conductor galvanically connected to the first end wall and extending transversely and perpendicularly from the first end wall towards the second end wall, the internal conductor ends being at a distance from the second end wall and/or is galvanically isolated therefrom, a pin-shaped or pin-like first tuning element, which protrudes towards the first end wall and which is electrically/galvanically connected to the second end wall, the first tuning element dipping into a longitudinal recess formed in the internal conductor tube, the first tuning element being mechanically anchored in the second end wall so as to be invariable in the axial length thereof and fixed in rotation, a second positionally variable tuning element being provided in the longitudinal recess of the internal conductor, the second tuning element consisting of or comprising dielectric material at least in the region facing the second outer wall, the second tuning element being variable in the axial position thereof in the space between the inner face of the internal conductor and the first tuning element, the second tuning element being accessible and/or actuatable from the outside of the first end wall so as to bring about a change in axial position.

2. High-frequency filter according to claim 1, wherein the second end wall comprises a dielectric plate material on the outside of which an earth plane is provided, to which the first tuning element is electrically/galvanically connected.

3. High-frequency filter according to claim 1, wherein a strip conductor construction is provided on the inside of the first end wall.

4. High-frequency filter according to claim 3, wherein the strip conductor construction comprises a coupling plane, in which a recess electrically/galvanically isolated from the coupling plane is provided, the coupling plane being arranged on the inside of the first end wall opposite the end face of the internal conductor and the first tuning element protruding through the recess into the internal conductor.

5. High-frequency filter according to claim 1, wherein the second end is in the form of a circuit board.

6. High-frequency filter according to claim 1, wherein the second tuning element comprises a blind hole or through-hole extending in the longitudinal direction of the second tuning element, and the second tuning element is positionally variable within the longitudinal recess in the internal conductor, in terms of the axial position thereof with respect to the first tuning element, in such a way that the first tuning element can be dipped different distances into the blind hole or through-hole of the second tuning element.

7. High-frequency filter according to claim 1, wherein the first tuning element and the second end wall are connected by an interference fit or by soldering or by welding, or in that the first tuning element and the second end wall are formed integrally.

8. High-frequency filter according to claim 1, wherein the external conductor housing is formed integrally with the internal conductor, in particular as a milled, turned or cast part.

9. High-frequency filter according to claim 1, wherein the external conductor housing and/or the internal conductor and/or the first tuning element consist of plastics material, the respective external faces being metal-coated.

10. High-frequency filter according to claim 1, wherein the second tuning element comprises an external thread, via which the second tuning element is connected to and held on an internal thread in the interior of the internal conductor and/or a recess of the first end wall.

11. High-frequency filter according to claim 1, wherein the thermal expansion coefficient of the second tuning element is different from the thermal expansion coefficient of the internal conductor or of the external conductor housing.

12. High-frequency filter according to claim 1, wherein the second tuning element comprises a ceramic material.

13. High-frequency filter according to claim 1, wherein air is provided as a dielectric between the internal conductor and the housing wall of the external conductor housing.

14. High-frequency filter according to claim 4 a plurality of resonators are provided, the strip conductor construction comprising a number of coupling planes corresponding to the number of resonators, said coupling planes being electrically/galvanically interconnected via a conductor path.

15. High-frequency filter according to claim 14, wherein the plurality of resonators are of different sizes.

16. High-frequency filter according to claim 14, wherein the resonators are configured and coupled so as to form a duplex filter.

17. High-frequency filter according to claim 1, wherein the at least one resonator is formed in such a way that a band-pass filter and/or a band-block filter is formed.

18. High-frequency filter according to claim 1, wherein the filter operates in the range between 790 MHz and 86s MHz and/or in the range between 870 MHz and 960 MHz and/or in the range of the 1800 MHz mobile radio frequency and/or the 2000 MHz mobile radio frequency.

* * * * *